US005597328A

United States Patent [19]

Mouissie

[11] Patent Number: 5,597,328

[45] Date of Patent: Jan. 28, 1997

[54] MULTI-POLE CONNECTOR WITH FILTER CONFIGURATION

[75] Inventor: Bob Mouissie, Ek Berlicum, Netherlands

[73] Assignee: Filtec-Filtertechnologie GmbH, Lippstadt, Germany

[21] Appl. No.: 372,653

[22] Filed: Jan. 13, 1995

[30] Foreign Application Priority Data

Jan. 13, 1994 [DE] Germany ..... 9400491 U

[51] Int. Cl.[6] ..... H01R 13/66

[52] U.S. Cl. ..... 439/620; 333/181

[58] Field of Search ..... 439/620; 333/181, 333/182, 185

[56] References Cited

U.S. PATENT DOCUMENTS

| | | | |
|---|---|---|---|
| 3,447,104 | 5/1969 | Schor | 333/79 |
| 4,144,509 | 5/1979 | Boutros | 333/181 |
| 4,752,752 | 6/1988 | Okubo | 333/181 |
| 4,931,754 | 6/1990 | Moussie | 439/620 |
| 4,950,185 | 8/1990 | Boutros | 439/620 |

*Primary Examiner*—Ted Kavanaugh
*Assistant Examiner*—Luan K. Bui
*Attorney, Agent, or Firm*—Herbert L. Lerner; Laurence A. Greenberg

[57] ABSTRACT

A multi-pole connector for connecting a number of signal lines includes a connector casing and rows of adjacent connecting pins and connecting sockets. At least one planar filter is adjacent one of the rows of the connecting pins or sockets. The at least one planar filter has edge regions producing a ground connection, a connecting site and a number of condensers corresponding to the number of signal lines to be connected. Each of the condensers is assigned to a respective one of the pins or sockets and each has a first coating connected to an associated signal line, a second coating to be connected to ground and a dielectric layer interposed between the first and second coatings. Each of the connecting pins or sockets has a connecting conductor connected to the connecting site. Securing connectors are conductively connected with the connector casing and secure at least one of the edge regions.

25 Claims, 5 Drawing Sheets

V
V

MULTI-POLE CONNECTOR WITH FILTER CONFIGURATION

BACKGROUND OF THE INVENTION

1. Field of the Invention:

The present invention relates to a multi-pole connector having a planar filter with a number of condensers corresponding to a number of signal lines to be connected, a condenser is disposed in conjunction with each terminal pin/socket of the multi-pole connector and is formed from a first coating to be connected through contact surfaces to an appropriate signal line, a second coating to be connected to ground through at least one edge strip and a dielectric layer interposed between the two coatings.

Multi-pole connectors which are employed either in transmitting digital or analog test or measuring signals from a multiplicity of testing devices or which are used in high-speed data transmission, require a filtering device in order to filter out interfering signals. The filtering of absorbed interference signals is accomplished, generally speaking, by using condensers that are disposed based on one per signal-carrying line. For that purpose, the condensers are advantageously grouped together in planar filters and used inside the multi-pole connectors.

In such a configuration, the planar filters are traversed by the signal lines and at least one condenser is provided for each of the signal-carrying lines. The condensers are disposed on one carrier which is, generally speaking, a ceramic, and in particular an aluminum-oxide carrier or the like. Should the individual signal leads be formed of pins that are pressed into plastic members or sections (as in "fit-in" connections), such pins cannot be soldered to the coating of the signal-electrodes that extend into the sockets. That type of multi-pole connector is disclosed, for example, in U.S. Pat. No. 3,447,104 and Published European Application No. 0 398 807. Employed inside those connectors are planar filters which are, as a rule, applied on top of an aluminum oxide substrate by using a screen printing procedure, in which the electrodes, (which are separated from each other by a non-conducting layer) are imprinted onto the layer first as a continuous ground electrode and second as discrete electrodes. The number of electrodes, which are insulated from each other, corresponds to the number of pins or, alternatively, sockets in the multi-pole connector. By virtue of their construction, such planar filters possess very low self-inductance, which causes their resonance to shift toward high frequencies, thus favoring application of such technology in high-speed signal transfer.

In such configurations, the planar filters are provided with openings through which the connecting pins, or sockets, are introduced, in which case the coating of the corresponding condenser is advantageously introduced into the opening where the electrical connection to the connecting pin or socket is achieved through soldering. However, in a few cases geometry prevents the planar filters from being disposed at right angles to either connecting pins or sockets.

SUMMARY OF THE INVENTION

It is accordingly an object of the invention to provide a multi-pole connector with a filter configuration, which overcomes the hereinafore-mentioned disadvantages of the heretofore-known devices of this general type and which enables implementation of a more advantageous planar filter technology allowing filtering with high speed-signal transfer, together with a simple and effective filter installation even in tightly-packed configurations.

With the foregoing and other objects in view there is provided, in accordance with the invention, a multi-pole connector for connecting a number of signal lines, comprising a connector casing; rows of adjacent connecting pins and connecting sockets; at least one planar filter being adjacent one of the rows of the connecting pins or sockets, the at least one planar filter having edge regions producing a ground connection, a connecting site and a number of condensers corresponding to the number of signal lines to be connected; each of the condensers being assigned to a respective one of the pins or sockets and each having a first coating connected to an associated signal line, a second coating to be connected to ground and a dielectric layer interposed between the first and second coatings; each of the connecting pins or sockets having a connecting conductor connected to the connecting site; and securing connectors being conductively connected with the connector casing and securing at least one of the edge regions.

The upright configuration of the planar filter or filters adjacent a row of connecting pins or sockets permits its installation between the latter and permits the suppression of interfering signals wherever the rows of connecting pins or connecting sockets are normally spaced.

In accordance with another feature of the invention, each of the planar filters is disposed between two rows of connecting pins or connecting sockets, or, alternatively, in the vicinity of two such rows. In this construction, the planar filter has condensers on at least one side and preferably on two sides, the connectors of which extend up to contact surfaces, whereby each of the connecting pins or connecting sockets is connected to its appropriate condenser through its contact surface by means of conductors or contact strips that form a metallic connection and which advantageously rest flexibly against either the contact surfaces or a connecting pin or connecting socket.

In accordance with a further feature of the invention, the planar filter is provided on both of its sides with condensers, which permits each adjacent row of connecting pins or connecting sockets to be connected by the shortest possible path to the contact surfaces of the planar filter. This configuration also permits all of the condensers of the planar filter to be disposed in a series of paired condensers, which has the effect of raising voltage stability. Grounding is ensured by the provision of at least one edge region of the planar filter capable of producing such connection, to which the ground electrode that is common to all of the condensers of the planar filter leads.

This region is connected to the common ground, and the connection is produced by means of securing tracks which mechanically accommodate and secure the planar filter and are metallically connected to the grounded housing. Another connection is provided by means of separate contact strips that produce the ground contact, if required, to conducting paths or surfaces of a grounded plate, or alternatively by means of a connection to a grounded connecting pin or connecting socket.

In accordance with an added feature of the invention, one planar filter which is disposed between each of two rows of connecting pins or sockets, forms or constitutes a filtering step for the connecting pins or connecting sockets of both of these rows. Both sides of the planar filter are printed with condensers, which enables the condensers of the planar filters facing each of the rows of connecting pins or connecting sockets, to connect through a short path to the corresponding connecting pin or connecting socket. The connecting conductors of adjacent connecting pins or sockets on oppositely-lying positions are, in this configuration, in metallic contact with the corresponding contact surfaces of the planar filter, so that the filtering effect is not impeded. Such dual-sided planar filters are manufactured in accordance with conventional planar filter technology. With the use of screen printing, the grounding electrode is printed upon most or substantially the entire surface of a carrier, which in general can be an aluminum-oxide plate. Applied to this grounding electrode is a non-conducting layer, normally being formed of a high-dielectric material, on top of which are placed the individual electrodes which serve as signal electrodes when connected to the connecting sockets. One alternative embodiment of this configuration in where a metallic carrier is used to form the ground electrode and which, like the applied-on ground electrodes of the embodiment described above, acts as an effective protective layer. Applied to both sides of this metallic carrier are non-conducting layers which are themselves provided with the individual electrodes that are to connect with the connecting sockets. A protective coating present in both embodiments protects these structures from the environment and from mechanical tampering.

This configuration also permits the construction of a connector with filters, should more than two rows of connecting pins or connecting sockets be provided. In the event that there is an uneven number of rows, one planar filter can be employed to serve the remaining row. The ground connection, which is required for effective filtering is, as a rule, achieved by a ground electrode common to all of the condensers. This ground electrode leads, in this case, to at least one of the lateral regions of the planar filter and is thus connected to the connector housing in a manner that permits conduction. The configuration of the planar filter in this embodiment permits one of the side pairs of the rectangular planar filters, preferably the narrow side, to be oriented parallel to the connecting pins or connecting sockets. It is advantageous if the ground electrode is extended to the longitudinal side, which reduces self-inductivity in the ground connection.

In accordance with an additional feature of the invention, which is preferred for use in the narrow space between the rows of connecting pins or connecting sockets, one planar filter is disposed beside each row of connecting pins or sockets. In this case, as in the previously described embodiment example, the planar filter has a plurality of rows of condensers, the number of which corresponds to the number of rows of connecting pins or connecting sockets designated to work with the planar filter. Due to the stacked configuration of the rows of condensers owing to the position of the planar filter, the leads connecting to the connecting pins or sockets occupy different planes. The planar filter is, just as in the previously described application example, oriented in such a way as to permit one of the lateral pairs of sides of the rectangular planar filter, preferably the narrow sides, to be oriented parallel in relation to the connecting pins or connecting sockets.

In accordance with yet another feature of the invention, the planar filter is situated, as a rule, outside of the rows of connecting pins or connecting sockets and is situated directly against the wall of the connector casing. It will, of course, be appreciated that a mixed application is also possible, so that the planar filter is disposed between two rows of connecting pins, or connecting sockets, and one planar filter is disposed outside of the rows, whereby both rows of connecting pins, or connecting sockets, which lie adjacent the planar filter or filters, can be connected to the latter.

In accordance with yet a further feature of the invention, which also allows the filter to be positioned between connecting pins or connecting sockets that are very tightly packed on the connector, the planar filter includes two rows of contact surfaces on one side, each row being separate from the other and running near one of the edges, which is advantageously a longitudinal edge, and the latter being disposed, in conjunction, alternatingly, with the even-numbered and the uneven-numbered condensers. The result is that contact surfaces which are constructed to work with the even-numbered condensers, are, for example, situated alongside the lower edge of the planar filter, while the contact surfaces constructed to work with the uneven-numbered condensers lie alongside the upper edge of the planar filter. Should the planar filter be provided on both sides with condensers, the corresponding rows of contact surfaces will, of course, be provided on both sides.

In accordance with yet an added feature of the invention, in order to form the electrical connection between the connecting pins or connecting sockets and the appropriate condensers, the connecting leads are constructed as flexible tongues that project from the connecting pin or socket. Such flexible tongues come into contact with the contact surfaces which, for this purpose, need not to be provided with openings for the admittance of connecting pins or connecting sockets that would otherwise be used in connection with planar filters employed in high-frequency filtering. It will suffice if these contact surfaces are bare, so as to permit the flexible tongues to rest against them, in which case the elastic properties of the flexible tongue material provide the necessary contact pressure. Since, in general, the connecting pins or connecting sockets are made from flexible material, it is advantageous to have the flexible tongues of the connecting leads formed by the side walls of the connecting pin or socket. Another advantageous construction of this configuration is where the flexible tongues meet the contact sites of the planar filter at an acute angle.

In accordance with yet an additional feature of the invention, which has particular application in a dual-row configuration of contact surfaces on one side of the planar filter, the contact surfaces have contact strips that lie against connecting surfaces of the appropriate connecting pins or connecting sockets and thus produce the contact between the latter and the appropriate condensers. Such contact strips can, in this configuration, be soldered or inserted into suitable holes in the planar filter carrier, in which case it will be understood that the aperture in the ground electrode must necessarily be made larger in order to prevent any unwanted contact to ground. Should the condenser electrodes which are connected to the connecting pins, or to the connecting sockets, be disposed on both sides of the planar filter, even in this case, the metallically-coated condenser layers are constructed to suppress undesired contact. This construction of the metallic coatings can readily be applied by using the screen printing technology known for the manufacture of such structures. As compared to the connection technology used in conjunction with planar filters that are disposed outside the rows of connecting pins or connecting sockets, this connection technology has the advantage of eliminating the need for longer contact strips, a configuration that limits self-inductance on the signal side.

In accordance with again another feature of the invention, the interior of the connector casing is conventionally filled in with synthetic inserts that have longitudinally-oriented recesses in the region of the flexible tongues. Such recesses allow the flexible tongues to retain mobility and mount flexibly against the contact surfaces.

In accordance with again a further feature of the invention, the connecting leads are constructed as contact pins that serve to connect the connecting pins or connecting sockets to the contact surfaces of the appropriate condenser of the planar filter. Advantageously, these contact pins, which are conductively connected to the connecting pins or connecting sockets, are connected to the contact surfaces of the planar filter. Produced preferably from an elastic-resilient material, the contact pins lie, in general, at right angles to the connecting pins or connecting sockets. In one advantageous embodiment, the contact pins are soldered to the planar filter. In another embodiment including planar filters provided with access openings, the contact pins are inserted into and preferably soldered inside, the openings provided in the planar filters.

In accordance with again an added feature of the invention, in order to suppress current leakage and to prevent flash-overs, the inside of the connector casing is filled in, by conventional techniques, with insulating synthetic inserts that constitute a multi-layer stacked layer, wherein at least one of the layers has groove-shaped recesses which lead to openings for the access of the connecting pins or connecting sockets to accommodate the contact pins. The latter are constructed as flat strips of metal which, being inserted into the groove-shaped recesses, extend into the access openings serving to accommodate the shafts of the connecting pins or connecting sockets and, when the connecting pins or connecting sockets are inserted into such access openings, they are dislocated and, being squeezed, form a metal-to-metal contact with the connecting pins or connecting sockets.

In accordance with a concomitant feature of the invention, if two rows of connecting pins or connecting sockets are being served by planar filters that are disposed laterally adjacent the rows of connecting pins or connecting sockets, the contact pins occupy different planes, so that those of one of the rows are disposed in one plane while those of the other row are disposed in another plane. For this purpose, two of the layers of the stacked layer have groove-shaped recesses extending to the appropriate access openings for the connecting pins or connecting sockets.

Other features which are considered as characteristic for the invention are set forth in the appended claims.

Although the invention is illustrated and described herein as embodied in a multi-pole connector with a filter configuration, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
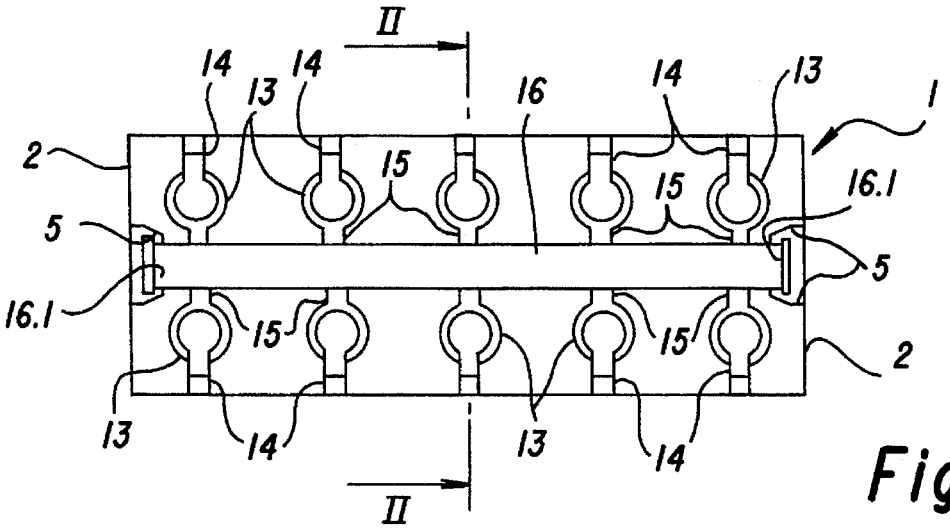
FIG. 1 is a diagrammatic plan view of a connector having two rows of connecting sockets with interposed planar filter.

Referring now to the single figure of the drawing in detail, there is seen a plan view of a plug connector 1 with a casing 2 as well as connecting sockets 13, which are shown in this case in two rows. Inserted between the two rows of connecting sockets 13 is a planar filter 16 having narrow sides which are inserted into securing tracks 5. Narrow sides of the planar filter 16, which are provided with ground contacts 16.1 are, firstly, mechanically held in position by means of the securing tracks 5 and, secondly, extend beyond the securing tracks 5 and are connected electrically to the grounded connector casing 2. The connecting sockets 13 are secured inside the casing by means of anchor strips 14, which fit into recesses in a wall of the casing 2. In this configuration, the anchor strips 14, which are angled toward the outside, function as securing elements. Anchor strips 15, which are oriented inwardly (by lying against contact surfaces of planar filter 16) provide electrical contact to condensers of the planar filter 16, and thus also help secure the connecting socket, since the planar filter 16 is already secured inside the securing tracks 5.

Figure 2:
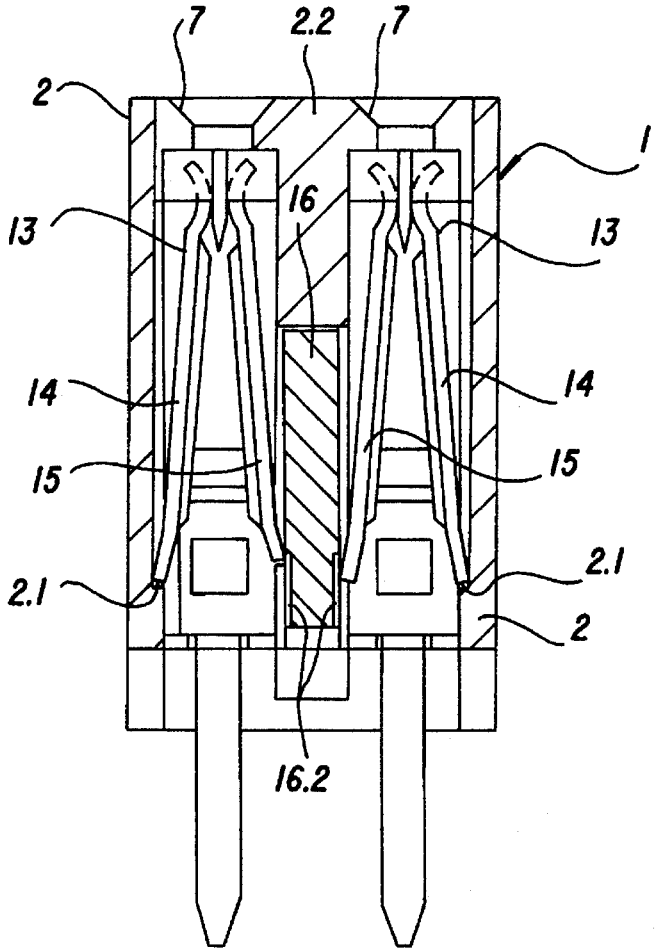
FIG. 2 is a cross-sectional view of the connector, which is taken along the line II—II of FIG. 1, in the direction of the arrows.

FIG. 2, which shows a section along a line II—II in FIG. 1, illustrates this relationship more clearly: The connecting sockets 13 are installed inside the casing 2 of the connector 1, they have the anchor strips 14 which open towards the outside and they fit into recesses 2.1 which secure the inserted connecting socket 13. The anchor strips 15, which open toward the inside, rest against contact surfaces or sites 16.2 of the planar filter 16, in a configuration that produces the conducting connection to the condensers of the planar filter 16.

Figure 6:
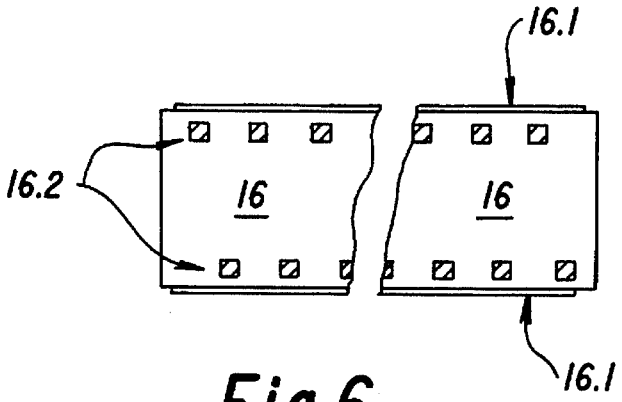
FIG. 6 is a fragmentary, diagrammatic, lateral view of a planar filter.
Figure 6A:
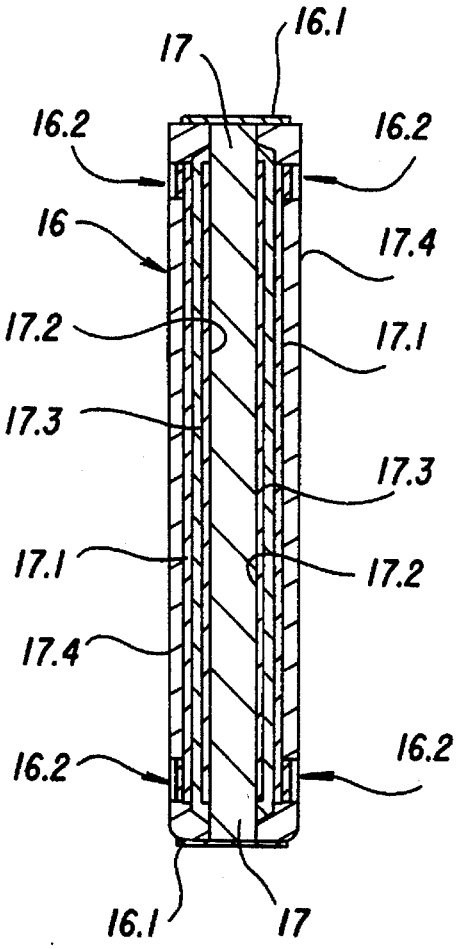
FIG. 6*a* is a cross-sectional view of an embodiment of the planar filter with an insulating carrier.
Figure 6B:
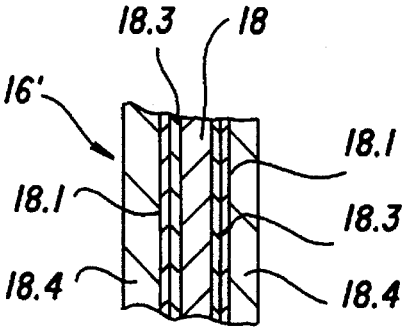
FIG. 6*b* is a fragmentary, cross-sectional view of an embodiment of the planar filter with a metallic carrier.

The latter, which is manufactured by means of screen printing technology, includes a single carrier 17 that in general is made of aluminum oxide, or a metallic carrier 18, which are respectively shown in FIGS. 6*a* and 6*b*. The carrier has conductive layers in the form of first and second coatings 17.1 and 17.2 applied to it by means of screen printing. For the purpose of constructing the condensers, at least one non-conducting dielectric layer 17.3 is also provided between these layers. The resulting layered structure is covered with an insulating protective layer 17.4. Thus, the conductive layers 17.1 and 17.2, which form the condensers, can be provided on both sides of the carrier 17 and the connections can be kept free of the insulating coating 17.4, in a configuration that produces the contact surfaces 16.2.

Figure 5:
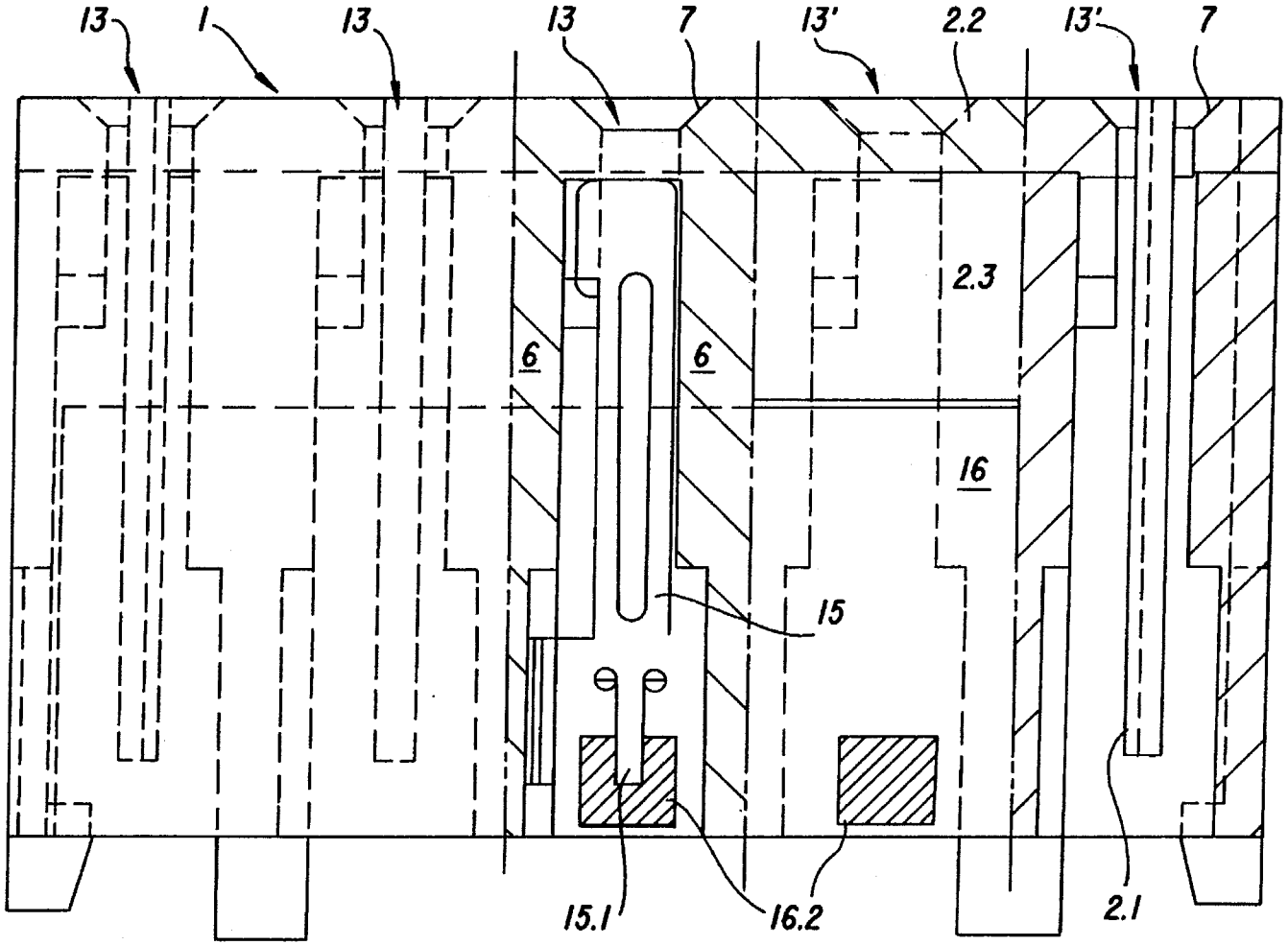
FIG. 5 is a cut away view of the connector shown in an illustration in accordance with FIG. 4 and taken along a line V—V of FIG. 3, in the direction of the arrows.

The connector 1 is closed off by means of a synthetic material member 2.2 (illustrated in FIG. 2 but not FIG. 1) that is either injection-molded in one piece or is later separately mounted and which, for the purpose of suppressing stray current, is provided with cone-like notches 7, into which cone-like projections of a mating connector fit. This configuration increases the length of the current leakage path. Furthermore, this insert is fitted with a strip-like molding 2.3 which is shown in FIG. 5 and which is molded either as a one piece member or is otherwise assembled and serves to hold the planar filter 16 in position.

Figures 3, 3A, 3B, 3C:
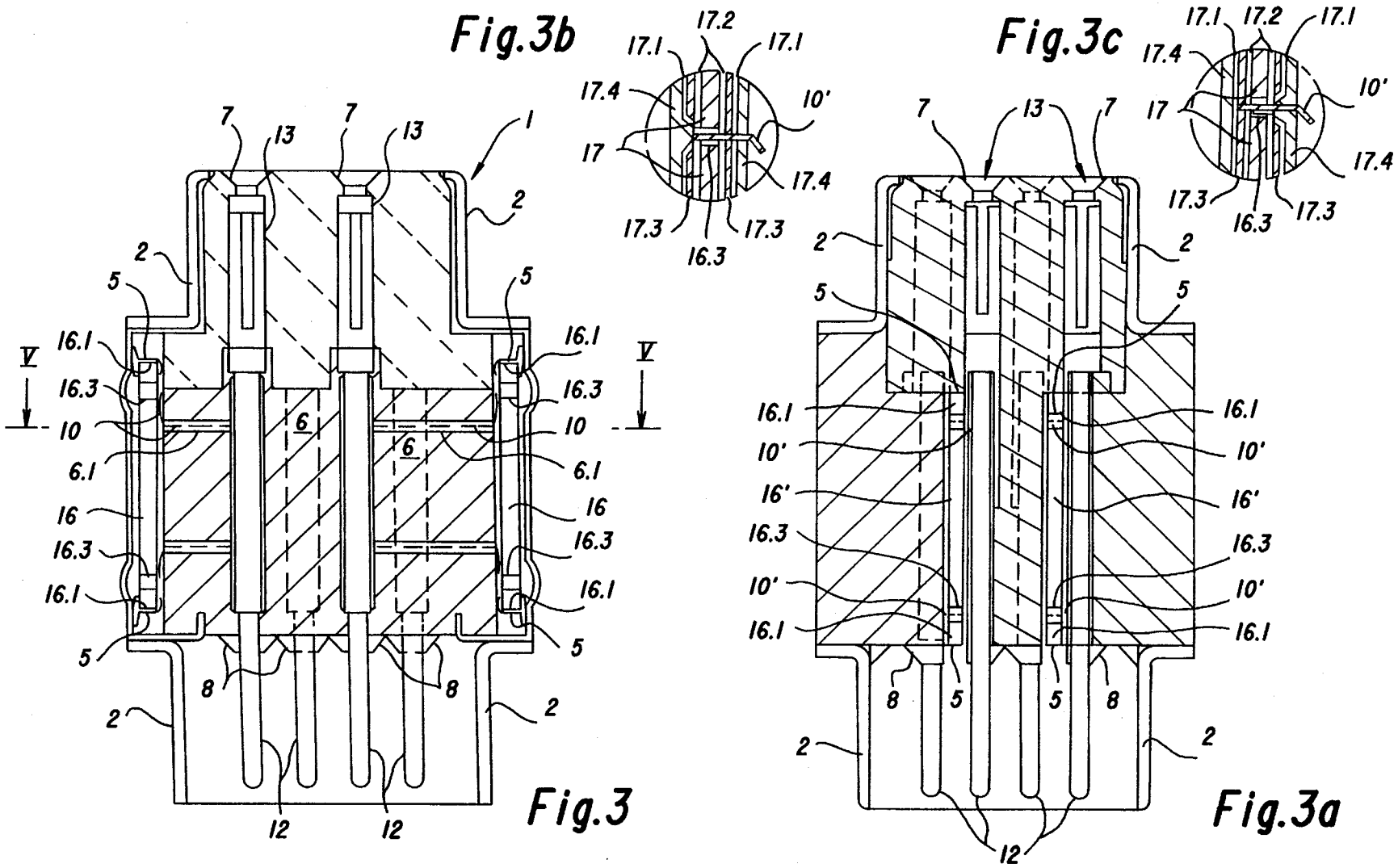
FIG. 3 is a cross-sectional view of a connector having four rows of connecting sockets.
FIG. 3*a* is a cross-sectional view of an alternative embodiment of the connector.
FIGS. 3*b* and 3*c* are fragmentary, enlarged, individual sections of contact surfaces.

FIG. 3 shows a section through a plug connector 1, which is shown as an adapter-connector having four rows of connecting pins 12 that correspond to the section shown in FIG. 2. In this configuration, the casing 2 of the connector 1 is formed from sheet metal, and inserts 6 of synthetic material are used to fill in the interior of casing 2. The longitudinal sides of planar filters 16 in this configuration are provided with ground contact elements 16.1. These longitudinal sides are held in place by means of the securing tracks 5. The securing tracks 5 are metallically connected to the casing 2 of the multi-pole connector 1 and form the electrical connection to ground. In order to accommodate the conducting connection or connections between the connecting pins 12 or, alternatively, the connecting sockets 13 and contact surfaces 16.2 or alternatively 16.3 of the planar filter 16 shown in FIGS. 6*a* and 3, the synthetic material inserts 6 are provided with grooves that serve as guide channels into which contact flanges 10 are inserted. The flanges, situated in the region of the connecting pin/socket access site, extend inwardly beyond the latter and are displaced whenever this connecting pin/socket combination is inserted. Since the size of the access openings in the synthetic material inserts 6 are selected particularly to accommodate the connecting pin/socket combination, the displaced portions of contact flanges 10 are pressed against the outermost areas of the connecting pin/socket combination, which results in excellent contact.

The end or ends of the contact strips that interact with the planar filter or filters form a conductive connection with the contact surfaces of planar filter 16. It is advantageous in this case to use planar filters that feature a conventional construction using one access opening 16.3 for each of the condensers. It will, of course, be appreciated that the condensers can be disposed on both sides, in order to increase either capacitance or voltage stability. Due to the access openings 16.3, access can be achieved for each of the condensers, and the ends of contact flanges 10 can be advantageously soldered into the access openings 16.3 of the planar filter 16. In this embodiment, the contact strips 10 are cut off so that a difference in size between a parting plane of the synthetic inserts 6 with guide grooves 6.1 or with guide channels in the case of compact synthetic blocks, and the access openings provided in planar filters 16, can be bridged. It will, of course, be appreciated that, instead of the stacked layer of synthetic inserts 6, a compact block can be employed, into which the access channels 6.1 are bored for the contact strips. The latter are advantageously formed as round pins in the region of such access channels, while that portion of the contact strip 10 which extends into each access channel for the connecting pin/socket combination, has a flattened portion.

In the embodiment shown in FIG. 3*a*, which corresponds to the illustration of the multi-pole connector of FIG. 3, two planar filters 16' are disposed between both paired rows of connecting sockets 13. The planar filters 16' used in this configuration, are held in place by means of longitudinally-running contact tracks 5 that form the ground-connection with the metallic casing 2. The latter features two rows of contact surfaces 16.2', which are disposed in rows along both edge regions of the planar filter 16'. As is seen from the enlarged individual sections in FIGS. 3*b* and 3*c*, each of the contact surfaces is provided with a contact strip 10' which is soldered into a hole 16.3 in the carrier 17 and is thus connected with an appropriate condenser coating 17.1. In this manner, it is capable of conducting signals. Ground electrodes 17.2, which are at ground potential, in this case are recessed in the region of the hole 16.3. Shown to the left of both enlarged detail illustrations is the appropriate condenser on the reverse side (as viewed from the contact strip) of the planar filter and to the right on its front side.

In the embodiment shown in this case, following assembly of the connector, a free end of the contact strip 10' lies against the appropriate metallic connecting socket 13. This configuration permits the planar filter 16' to be kept very flat, and to be employed with very tightly-configured connectors. In such configuration, the contact strips 10', which are disposed in practically completely symmetrical fashion, can be kept short, which limits both undesired self-induction and spreads out its distribution.

Figure 4:
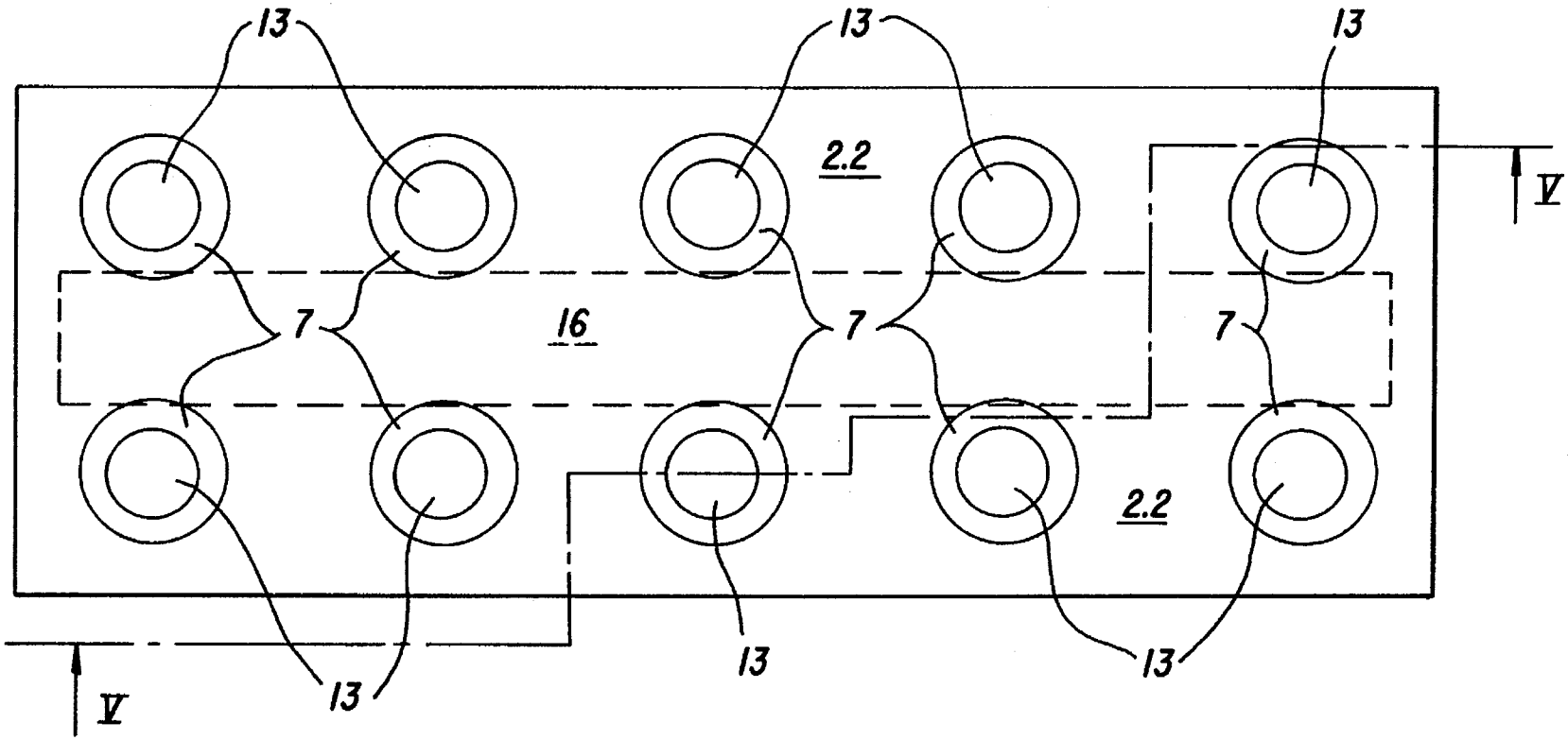
FIG. 4 is a plan view of a section of the connector in accordance with FIG. 1.

FIG. 4 shows a diagrammatic plan view of a connector 1 having two rows of connecting sockets 13. In the embodiment shown, each row possesses five sockets (with it being understood that the scope of the invention is not limited to this number). It will also be appreciated that these connecting sockets 13 can be set to "open". A planar filter 16, which is indicated in this case by means of broken lines, is situated between the two rows of connecting sockets 13, as in FIG. 2. The section line V—V, which changes direction in a number of places, indicates how the multi-pole plug connector 1 in FIG. 5 is sectioned.

FIG. 5 shows an external view of the left-hand region of the multi-pole connector 1. The previously inserted and hidden connecting sockets 13 are also indicated by means of broken lines, as is the planar filter 16, which is situated in the center of the illustration. The centrally-located connection socket 13 is recognizable in a central region by a broken line and sits against the contact surface 16.2 of the planar filter 16 with the aid of flexible tabs 15.1 of anchor strips 15. Elements 10 and 15 form connecting conductors connected to a connecting site of the planar filter 16. The latter are oriented towards the inside and thus can be seen directly above the contact surface 16.2, together with the appropriate electrode of the condenser of the planar filter 16. In this figure the latter is shown only on both sides of the connecting socket 13, with the socket itself being inserted securely into the molding of the casing of multi-pole connector 1. To the right of this central region, the direction of the section line changes again to show the side wall of planar filter 16 with a contact surface 16.2 for this region. The planar filter is held in position by means of the strip-like molding or depressing element 2.3 that is molded onto a synthetic insert 2.2. The connecting socket 13, which is hidden in the background row, is indicated in this figure by means of a broken line. The subsequent path of the section line V—V leads into this occluded row of connecting sockets. Although the connecting socket itself has not been drawn in, a recess 2.1 is visible. In the recess, an outwardly-oriented anchor strip 14 (FIG. 2) is provided and functions as securing means.

FIG. 6 shows a diagrammatic view of a planar filter 16. The planar filter 16 has longitudinal lateral edges which are coated with contact surfaces 16.1 for the ground electrode/electrodes, that are conductively connected with securing tracks 5 (FIG. 3), after insertion in the plug connector 1. Disposed in two rows near the longitudinal lateral edges are extended contact surfaces 16.2', in which the contacts are disposed in alternating fashion. This results in a configuration in which the distances between any adjacent contact surfaces 16.2' are twice as great as the distances between the designated connecting pins 12 or connecting sockets 13.

Finally, FIGS. 6*a* and 6*b* show cross sections through the planar filter 16 itself. The embodiment according to FIG. 6*a* essentially includes an insulating carrier 17 (generally a aluminum-oxide material) which is provided on both sides with a first flat, continuous conducting layer 17.2 which is conductively connected to an external contact surface 16.1 in the form of a grounded electrode. In this way, being a planar double-electrode, it constitutes a protective cover that seals off both rows of the connecting pins 12 or connecting sockets 13 from each other.

Applied to the conducting surfaces 17.2 is a non-conducting dielectric layer 17.3 that serves as an insulator for the condensers. Highly-dielectric materials known in thick or thin film technology, for example barium titanate, would as a rule be employed in this configuration. Applied on top of this continuous non-conducting layer are the individual condenser coatings 17.1 which together with the contact surfaces 16.2 form a conductive connection with the connecting pins 12 or connecting sockets 13 as the case may be. The entire planar filter 16, which as a rule is produced by means of screen printing technology, is then covered by a protective layer 17.4 which protects the device from the environment or from mechanical tampering.

FIG. 6*b* shows another construction of this type of double-sided planar filter 16. In this case, the carrier 17 is a metallic plate onto which a non-conducting layer 18.3 is directly applied, with the latter having individual condenser electrodes 18.1. The continuous ground electrode, although omitted from this configuration, is formed by the metallic carrier plate, which, for this purpose, possesses the required conductive and protective capabilities.

I claim:

1. In a multi-pole connector for connecting a number of signal lines, the improvement comprising:

a connector casing;

rows of adjacent connecting pins and connecting sockets;

at least one planar filter having a number of condensers being adjacent one of said rows of said connecting pins or sockets, said at least one planar filter having edge regions producing a ground connection and a connecting site producing connections between the signal lines and said condensers, the number of condensers corresponding to the number of the signal lines to be connected;

each of said condensers being assigned to a respective one of said pins or sockets and each having a first coating connected to an associated signal line, a second coating to be connected to ground and a dielectric layer interposed between said first and second coatings;

each of said connecting pins or sockets having a connecting conductor connected to said connecting site;

securing connectors being conductively connected with said connector casing and securing at least one of said edge regions; and said rows of said connecting pins and sockets being disposed in pairs, said at least one planar filter including one planar filter disposed between each of said pairs of rows of said connecting pins or sockets, said planar filter having contact sites and having sides both being printed with said condensers, said connecting conductors of said adjacent connecting pins or sockets lying on opposing sites of said corresponding contact sites, said planar filter having a number of said rows of condensers corresponding to said rows of connecting pins or sockets assigned to said planar filter, and said planar filter being rectangular and having pairs of sides, one of said pairs of sides being oriented parallel to said connecting pins or sockets.

2. The connector according to claim 1, wherein said pairs of sides of said rectangular planar filter being oriented parallel to said connecting pins or sockets are narrow sides.

3. The connector according to claim 1, wherein said planar filter includes an insulating carrier having a surface, said second coating is a ground electrode being applied over substantially all of said surface of said insulating carrier, said dielectric layer covers said ground electrode, individual electrodes are applied to said dielectric layer for connection to said connecting pins or sockets, and a protective covering is disposed on said insulating carrier.

4. The connector according to claim 1, wherein said at least one planar filter includes a metallic carrier having a surface, said dielectric layer covering substantially all of said surface of said metallic carrier, individual electrodes being applied on said dielectric layer for connection to said connecting pins or sockets, and a protective covering disposed on said at least one planar filter.

5. The connector according to claim 3, wherein said contact sites have contact pins or strips.

6. The connector according to claim 1, wherein said connecting conductors are flexible tongues extending from said connecting pins or sockets.

7. The connector according to claim 6, wherein said connecting pins and sockets have side walls, and said flexible tongues are formed from said side walls of said connecting pins or sockets and make contact with said contact sites of said at least one planar filter at an acute angle.

8. The connector according to claim 6, including synthetic inserts filling the interior of said connector casing, said inserts having longitudinally-oriented recesses in the vicinity of said flexible tongues for maintaining mobility of said flexible tongues.

9. The connector according to claim 5, wherein said contact pins or strips have one end lying against said connecting pins or sockets and another end lying against said contact sites of said condensers of said at least one planar filter.

10. The connector according to claim 9, wherein said contact pins or strips are formed of the same material as said connecting pins or sockets.

11. The connector according to claim 9, wherein said contact pins or strips lie against said contact sites of said at least one planar filter.

12. The connector according to claim 9, wherein said contact pins or strips lie flexibly against said connecting pins or sockets.

13. The connector according to claim 9, wherein said contact pins or strips are in contact with and metallically connected to said contact sites of said at least one planar filter.

14. The connector according to claim 13, wherein said contact pins or strips are soldered to said contact sites of said at least one planar filter.

15. The connector according to claim 9, wherein said contact pins or strips are introduced into openings formed in said at least one planar filter, except for at least said ground electrode in the vicinity of said opening.

16. The connector according to claim 15, wherein said contact pins or strips are soldered into said openings formed in said at least one planar filter.

17. The connector according to claim 8, including flat contact strips, said synthetic inserts forming at least one stacked layer having groove-shaped recesses formed therein for accommodating said flat contact strips, said flat contact strips having ends initially extending into access openings for said connecting pins or sockets during assembly and being displaced and forming an electrical contact with said connecting pins or sockets following insertion of said connecting pins or sockets.

18. The connector according to claim 1, including contact strips, and a compact synthetic insert filling the interior of said connector casing, said compact synthetic insert having guide channels for accommodating said contact strips, said contact strips having ends initially extending into access openings for said connecting pins or sockets during assembly and being displaced and making electrical contact with said connecting pins or sockets following introduction of said connecting pins or sockets.

19. The connector according to claim 18, wherein said ends of said contact strips are flattened.

20. In a multi-pole connector for connecting a number of signal lines, the improvement comprising:

a connector casing;

rows of adjacent connecting pins and connecting sockets;

at least one planar filter having a number of condensers being adjacent one of said rows of said connecting pins or sockets, said at least one planar filter having edge regions producing a ground connection and a connecting site producing connections between the signal lines and said condensers, the number of condensers corresponding to the number of the signal lines to be connected;

each of said condensers being assigned to a respective one of said pins or sockets add each having a first coating connected to an associated signal line, a second coating to be connected to ground and a dielectric layer interposed between said first and second coatings;

each of said connecting pins or sockets having a connecting conductor connected to said connecting site:

securing connectors being conductively connected with said connector casing and securing at least one of said edge regions; and said at least one planar filter being disposed adjacent one of said rows of said connecting pins or sockets, said planar filter having sides and contact sites, said condensers being printed on at least one of said sides, said connecting conductors leading from said associated connecting pins or sockets to said corresponding contact sites, said planar filter having a number of said rows of said condensers corresponding to the number of said rows of said connecting pins or sockets assigned to said planar filter, and said planar filter being rectangular and having pairs of sides, one of said pairs of sides being oriented parallel to said connecting pins or sockets.

21. The connector according to claim 20, wherein said pairs of sides of said rectangular planar filter being oriented parallel to said connecting pins or sockets are narrow sides.

22. The connector according to claim 20, wherein said planar filter includes an insulating carrier having a surface, said second coating is a ground electrode being applied over substantially all of said surface of said insulating carrier, said dielectric layer covers said ground electrode, individual electrodes are applied to said dielectric layer for connection to said connecting pins or sockets, and a protective covering is disposed on said insulating carrier.

23. The connector according to claim 20, wherein said at least one planar filter includes a metallic carrier having a surface, said dielectric layer covering substantially all of said surface of said metallic carrier, individual electrodes being applied on said dielectric layer for connection to said connecting pins or sockets, and a protective covering disposed on said at least one planar filter.

24. The connector according to claim 22 wherein said contact sites have contact pins or strips.

25. The connector according to claim 24, wherein said contact strips are disposed in different planes.

* * * * *